US005423441A

United States Patent [19]

Conti

[11] Patent Number: 5,423,441

[45] Date of Patent: Jun. 13, 1995

[54] CLOSURE SYSTEM FOR A CONTAINER AND CAP

[75] Inventor: Vincent N. Conti, West Hempstead, N.Y.

[73] Assignee: American Safety Closure Corp., West Hempstead, N.Y.

[21] Appl. No.: 169,066

[22] Filed: Dec. 20, 1993

[51] Int. Cl.[6] ..... B65D 55/02

[52] U.S. Cl. ..... 215/225; 215/230; 215/256; 215/258; 215/44

[58] Field of Search ..... 215/224, 225, 230, 253, 215/254, 256, 258, 305, 31

[56] References Cited

U.S. PATENT DOCUMENTS

| | | | |
|---|---|---|---|
| 3,991,904 | 11/1976 | Davis et al. | 215/334 |
| 4,071,156 | 1/1978 | Lowe | 215/224 |
| 4,342,400 | 8/1982 | Llera | 215/256 |
| 4,417,666 | 11/1983 | Roberts | 215/256 |
| 4,449,639 | 5/1984 | Davis | 215/224 |
| 4,511,051 | 4/1985 | Desai | 215/225 |
| 4,524,876 | 6/1985 | Kusz | 215/224 |
| 4,573,599 | 3/1986 | Fillmore | 215/225 |
| 4,919,286 | 4/1990 | Agbay, Sr. | 215/235 |
| 5,097,974 | 3/1992 | Rozenberg | 215/225 |
| 5,143,235 | 9/1992 | Repp | 215/256 |

*Primary Examiner*—Gary E. Elkins
*Assistant Examiner*—Vanessa Caretto
*Attorney, Agent, or Firm*—Nolte, Nolte and Hunter

[57] ABSTRACT

Tamper indicating, child proof system includes annular tear strip on the cap; and a rotatably indexing latch finger on the cap which engages a raised annular retainer ridge with bypass opening on the neck of the container. A tactile indicator of the rotational location of the bypass opening is under the tear strip for sensing by a finger that is in simultaneous contact with the cap, when the tear strip is removed. A lower ridge includes an index key for orienting the latch finger away from the bypass opening during assembly of the system.

4 Claims, 2 Drawing Sheets

CLOSURE SYSTEM FOR A CONTAINER AND CAP

BACKGROUND OF THE INVENTION

1. Field of the Invention

This invention relates to closures for containers, more specifically to a tamper indicating, child proof, reusable snap-off cap and container closure system.

2. Description of the Prior Art

The container closure art is replete with tamper-indicating, child proof designs including caps with frangible elements connecting the cap to the container, and with spring loaded bayonet locking means, spring loaded ratchet means, and other arrangements which make it difficult for a child to open the container once the frangible element is breached.

U.S. Pat. No. 4,449,638, patented May 22, 1984 by E. Davis describes a tamper indicating, child proof design of a container having a cylindrical neck with open top mouth. The mouth opening also continues through a portion of the neck in a vertical finger width slot.

A cap with a rotatable plug and a lower skirt is pressed over the neck, whereby the skirt engages annular raised ridges on the neck of the cap preventing subsequent removal of the skirt from the neck. The plug extends into and seals the open top mouth.

An annular tear band joins the upper portion of the cap with the skirt, and also is attached by telltale bridge members to the plug. Tearing away the band separates the top of the cap from the skirt, and breaks the bridge members to further indicate the initial breach of the closure.

The plug has a radially oriented finger hole which must be accessed by way of the finger width slot, in order to be able to apply upward pressure to the plug by a finger to remove it with the cap top from the container. The upward finger pressure can only be applied to the plug from within the plug.

The top of the plug includes an arrow to help the user rotate the plug finger hole into alignment with the slot.

U.S. Pat. No. 4,449,639, patented by E. Davis, on May 22, 1984, describes a tamper-indicating, child-resistant closure with a cap having a top part, a tear band in the middle, and a captive band at the bottom, cooperating with the neck of the container.

In assembly, the cap is forced onto the neck until a pair of annular parallel raised ridges in the inside of the captive band pass a corresponding pair of annular parallel raised ridges on the outside of the container neck, thereby irreversibly retaining the captive band on the neck.

The top part of the cap has an arcuate internal lug to engage below an arcuate external projection on the rim of the container neck to keep the cap on the container after the tear band is removed by pulling on a pull tab. The cap then cannot be removed until it is rotated so that the lug disengages from the projection to free the cap for removal from the neck. Indication is given for rotation of the cap to the disengagement position, for example, by an upward pointing arrow on the outer surface of the container, and a serrated grip tab by which the cap is lifted, shaped into a downward pointing arrow.

To breach the closure and to open the container, the user tears away the band. Frangible bridge members attached variously to the cap top, tear band, pull tab, and captive band, provide indication of tampering by breaking when the tear band is removed.

The user then lines up the two arrows to bring the cap into position for removal, and urges the cap up and off the container by way of a serrated grip tab.

SUMMARY OF THE INVENTION

Objects of the present invention include providing a child proof, tamper indicating closure that can be operated by a person without need for glasses and with minimum manual dexterity.

Accordingly, it is one object of the invention to provide a closure with an unobstructed finger grip area for applying pressure to urge the cap away from the opening.

It is another object of the invention to provide a closure with a tear strip to persuade against tampering, and to provide clear indication of breach of the closure.

Another object is to provide a closure that is child proof by requiring rotating of the cap to a predetermined position in order to be able to remove the cap.

Another object is that indication be provided on the container and cap of the predetermined position to be attained.

Another object is that tactile indication of the predetermined position be provided in a closure that is child proof and tamper indicating, for sensing by the finger that is operating the finger grip area, as the finger is rotating the cap to the predetermined position.

Another object is to provide a combination visual, tactile, and assembly, index means on the container to help the user locate the predetermined position, and to help in assembly to index the cap and container so that the cap will not by happenstance be in the predetermined position when the tear strip is removed. This further enhances the child proof feature of the invention.

Another object is to provide a seal of the container by the closure cap that has reduced resistance to rotation of the cap.

Other objects and advantages will become readily apparent to one reading the ensuing detailed description of the invention.

The closure system container neck includes, in order from the opening in the neck, first, second and third annular raised retainer ridges which are generally parallel and spaced from one another. The system cap includes an annular inner wall, and depending from the periphery of the wall, an annular skirt having a first end comprising the periphery of the inner wall.

On an inner side of the skirt, in order from the first end, first, second, and third annular raised anchor ridges for bearing respectively against the first, second and third retainer ridges on their distal sides with respect to the opening when the cap is fully seated on the neck over the opening.

First and second separation bands of reduced thickness of the skirt are located respectively between the first and second anchor ridges, and between the second and third anchor ridges.

A tear strip annular portion of the skirt between the first and second bands, when removed by means for pulling it, frees the cap from the remainder of the skirt distal from the first band so that the cap is independent from the container when the cap is removed from the neck.

The first anchor ridge is discontinuous and has in series a single narrow latch finger extending generally normally from the inner side of the skirt. A narrow portion of the first retainer ridge is of reduced height forming thereby a latch finger bypass opening through which the latch finger can pass for initiating removal of the cap from the neck.

Preferably, no other raised portion of the first anchor ridge is narrower than the bypass opening.

Finger grip means is provided for urging the cap away from the opening.

The closure system also includes, generally under the tear strip, means, within the inclusive region from the second retainer ridge to the third retainer ridge, for tactile indication by a finger of an operator of the rotational location of the bypass opening by rotation of said cap while the finger is simultaneously in contact with the finger grip means.

On a fourth annular raised ridge on the outer surface of the neck, the fourth ridge being spaced from the third retainer ridge distally from the opening, is an index key in predetermined location with respect to the latch finger bypass. The index key comprises a narrow portion of the fourth ridge having a change in shape with respect to the general shape of the remainder of the ridge. Preferably, the change in shape extends in a raised portion of the neck generally normal to the fourth ridge.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
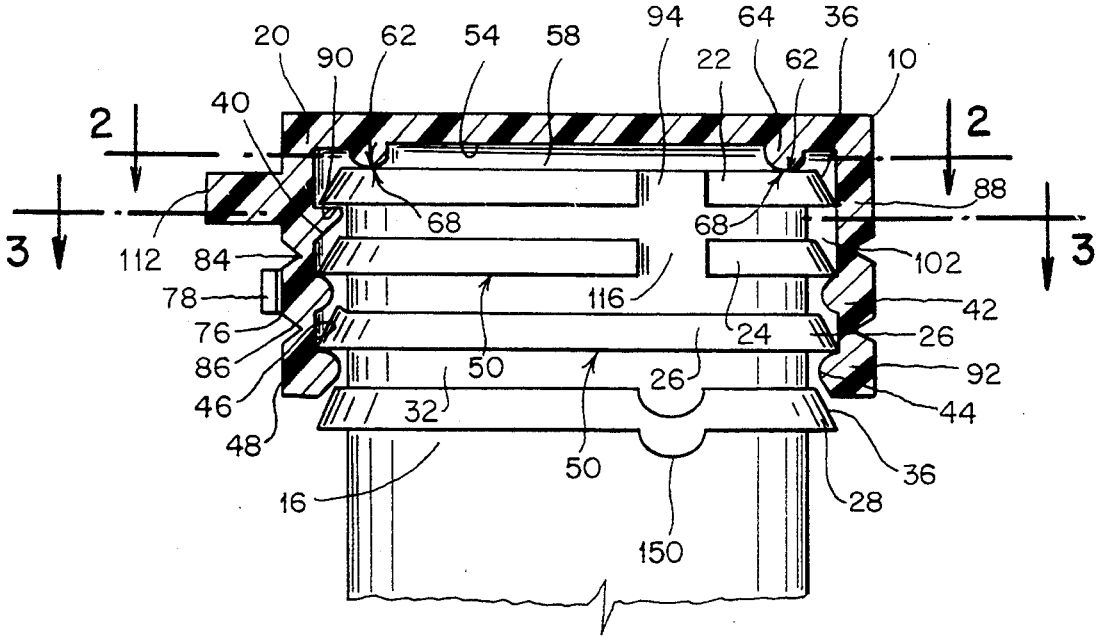
FIG. 1 is a front view of a closure system constructed according to the present invention. The cap portion is in cross sectional view.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to the drawings, FIG. 1 shows a closure system 10, on the upper portion 12 of a container body (not shown). The closure system comprises elements on neck portion 16 of upper body portion 12, in cooperation with cap 20. Neck 16 may be cylindrical, conical or take any generally circular form when considered in cross section.

Figure 2:
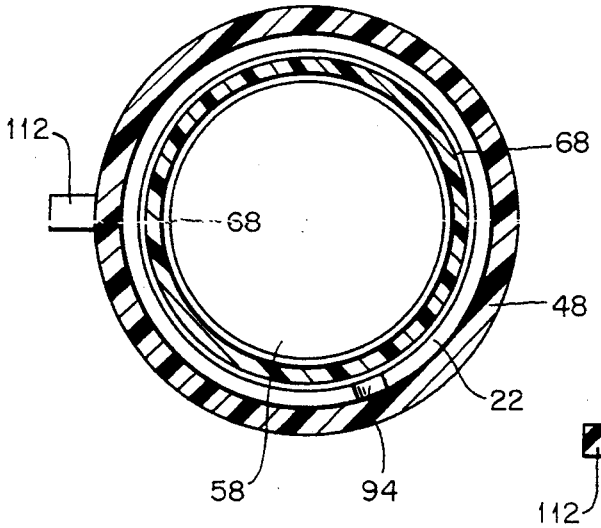
FIG. 2 is a top sectional view of the closure system shown in FIG. 1, taken along lines 2—2.
Figure 3:
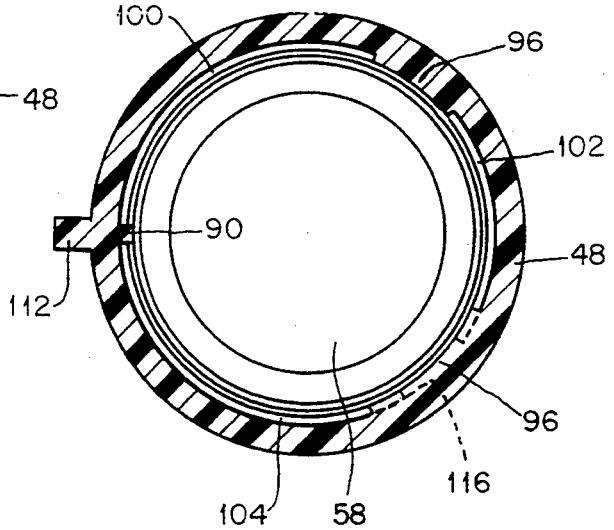
FIG. 3 is a top sectional view of the closure system shown in FIG. 1, taken along lines 3—3.
Figure 4:
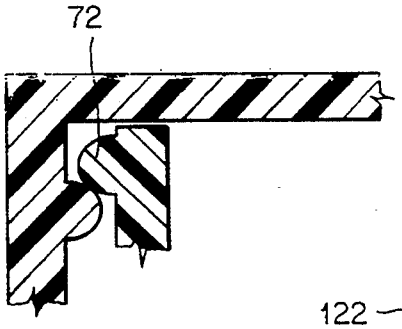
FIG. 4 is a sectional view of a portion of another closure system according to the invention.

Referring to FIGS. 1, 2, and 3, neck 16 includes annular raised retainer ridges 22, 24, 26, and 28, on the outer surface 32 of neck 16. The upper leading edges 36 of the retainer ridges are preferably angled down and out as the straight angle shown in FIG. 1 or curved out and down, as is retainer ridge 72 shown in FIG. 4.

Angled or curved leading edge 36 eases initial assembly of the cap on neck 16. As it is forced down over the neck, anchor ridges 40, 42, and 44 on the inner side 46 of skirt 48 must slip over the outer diameters of the retainer ridges, and snap-in below retainer surfaces 50, thus locking the cap on the neck.

The raised retainer and anchor ridges are preferably, but not necessarily, molded on the surfaces from which they rise. Ridges 22, 24, and 26 are generally parallel with one another.

Annular inner wall 54 seals container opening 58 by way of cap sealing surface 62 of annular seal ring 64 bearing upon opening sealing surface 68 of neck.

Annular seal ring 64 preferably contacts with annular sealing surface 68 only in a narrow band which is set back from, and does not include the outer surface of the neck. This provides an effective seal normal to the opening sealing surface, without incurring additional frictional resistance to rotation from contact with adjacent surfaces.

When it is desired to unseal the closure system, annular tear strip 76 is pulled by tab 78 out of skirt 48 by tearing the strip along bands of reduced thickness 84 and 86. This separates tear strip 76 from annular rings 88 and 92.

After strip 76 is removed, ring 92 remains on neck 16, between annular raised retainer ridges 26 and 28.

Only annular anchor ridge 40, rising from inner side 46 of the skirt, and engaging retainer surface 50 of annular raised retainer ridge 22, keeps cap 20 from being lifted away from the container opening.

Figure 5:
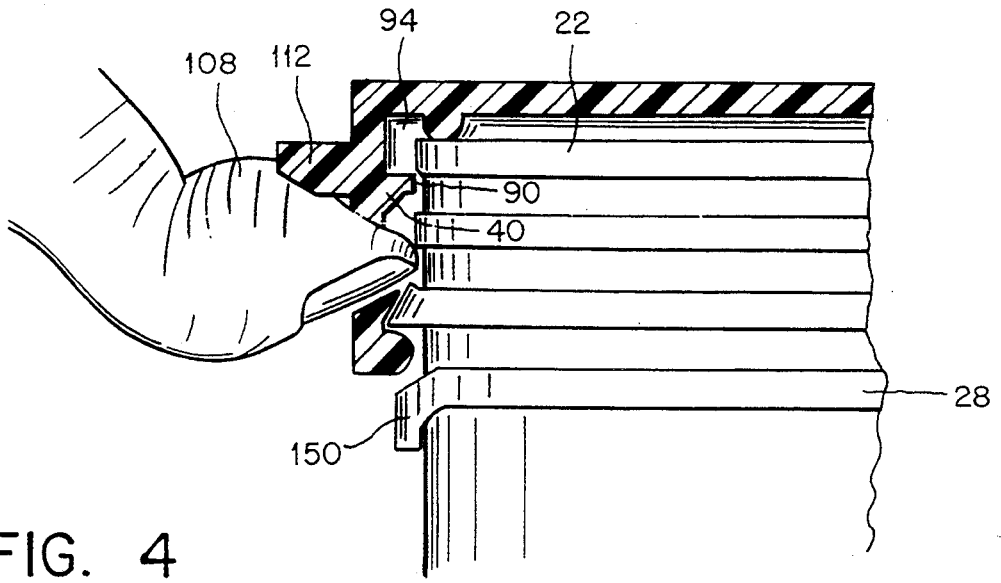
FIG. 5 is a sectional side view of the closure system shown in FIG. 1, with the cap set on the container to the predetermined position which unlocks the cap, and with a finger at the position in which the predetermined position is discovered.

Referring additionally now to FIG. 5, in order to be able to remove the cap, it must be rotated until latch finger 90 portion of anchor ridge 40 is under bypass opening 94 in retainer ridge 22. Retainer ridge 22 is preferably continuous but for latch finger bypass opening 94 which is just a little wider than the latch finger.

Anchor ridge 40 is preferably discontinuous or comprises portions of lower height so that three annular raised portions remain, a narrow one that is latch finger 90, and two small pivot arcs 96, FIG. 3, which follow out from under ridge 22 when latch finger 90 is urged up through bypass opening 94.

The three discontinuous areas 100, 102 and 104 of anchor ridge 40 permit the cap to be urged upward and off from the neck by finger 108 pressure against finger grip protrusion 112.

It is not necessary for an operator to visually examine the container to find the predetermined location for lining up the latch finger with the bypass opening. Retainer ridge 24 has a change in shape 116, preferably a discontinuity or reduction in height, that is in line with the predetermined location. This change in shape provides tactile indication of the rotational location of the bypass opening. The tactile indication is provided to the operator by contact by a finger of the operator with change 116 during rotation of the cap by the finger while the finger is simultaneously in contact with the finger grip.

Figure 6:
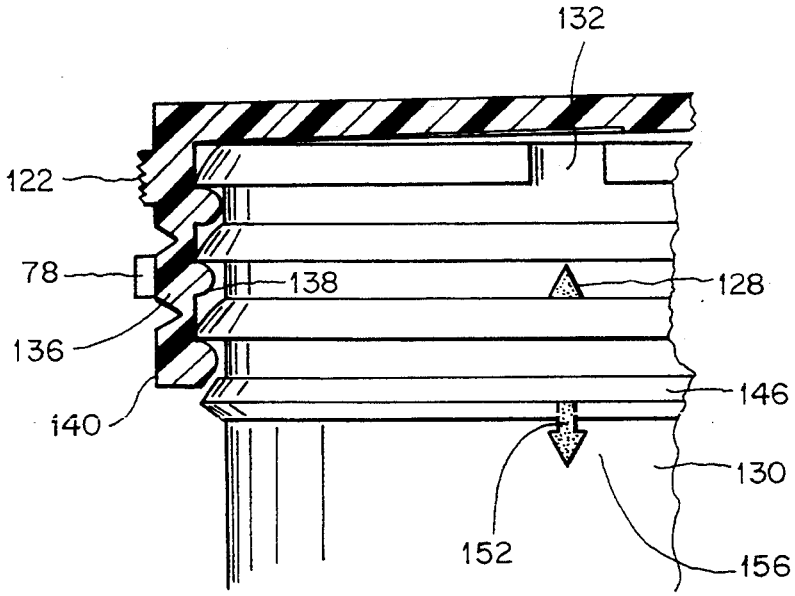
FIG. 6 is a sectional side view of a preferred embodiment of the invention.

Although finger grip 112 shown in FIG. 5 is quite large by comparison to the finger, the tactile indication works as well with just a small finger grip, for example finger grip 122 shown in FIG. 6.

Referring to FIG. 6, tear strip 136 is designed to accommodate a tactile indicator. Space is provided in the region between minor diameter surface 138 and the outer surface of neck 130 to allow for the volume of space taken up by tactile indicator 128 when tear strip 136 is in skirt 140.

Tactile indicator 128 on neck 130 provides tactile indication of the rotational location of bypass opening 132 when a finger is on finger grip 122, in the same manner as does change in shape 116 in retainer ridge 24 described above.

Tactile indicator 128 has a narrow raised arrowhead shape with a roughened surface that is easily detected by a passing finger.

Retainer ridge 28 in FIGS. 1 and 5, and retainer ridge 146 in FIG. 6 include narrow portions 150 and 152 respectively of change in shape with respect to the general shape of the remainder of the ridge. These narrow portions are index keys which provide a combination visual, tactile, and assembly index means to help the operator locate the predetermined position, and to help in assembly to index the cap and container so that the cap will be located away from the predetermined position when the container with sealed closure system is delivered to the customer.

Index key 152 is a narrow, arrow shaped element that includes raised portions of ridge 146 and adjacent outer surface 156 of neck 130.

Figure 8:
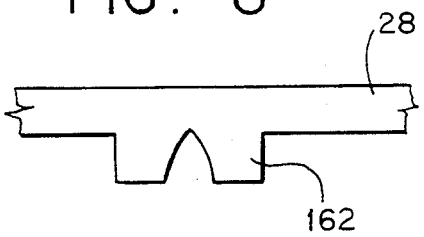
FIG. 8 is a sectional view of a tactile position indicator according to the invention.
Figure 7:
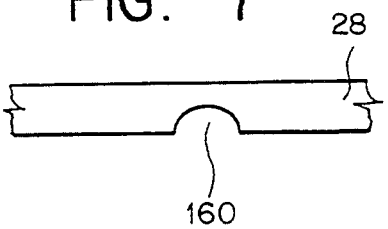
FIG. 7 is a sectional view of a tactile position indicator according to the invention.

The index key may take whatever convenient shape desired to suit its above described purpose, such as the shapes described, and index keys 160 and 162 shown in FIGS. 7 and 8 respectively.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. A closure system for a container and cap, said container having body and a neck of said body comprising an opening into said body, said cap being for reversibly sealing said opening and comprising a closure seal, said neck and cap comprising a child proof lock, said closure system providing indication to a user of a first time breach of said closure seal, and comprising:

on an outer surface of said neck, in order from said opening, a first annular raised retainer ridge, a second annular raised retainer ridge generally parallel to and spaced from said first retainer ridge, and a third annular raised retainer ridge generally parallel to and spaced from said second retainer ridge, said cap including an annular inner wall, and depending from the periphery of said inner wall, an annular skirt comprising an inner side, an outer side, a first end, and a second end, said first end comprising said periphery of said inner wall, and on said inner side, in order from said first end, a first annular raised anchor ridge, a second annular raised anchor ridge generally parallel to and spaced from said first anchor ridge, and a third annular raised anchor ridge generally parallel to and spaced from said second anchor ridge, said first, second and third anchor ridges being for bearing respectively against the first, second and third retainer ridges on their distal sides with respect to said opening, when said cap is fully seated on said neck, over said opening, said skirt comprising first and second separation bands of reduced thickness of said skirt, said first band being located between said first and second anchor ridges, said second band being located between said second and third anchor ridges, a tear strip comprising the annular portion of the skirt that is between said first and second bands, wherein removal of said tear strip frees said cap from the remainder of said skirt distal from said first band so that said cap is independent from said container when said cap is removed from said neck, means for pulling said tear strip from said skirt, said first annular raised anchor ridge being discontinuous and having in series a single narrow latch finger in the plane of said first anchor ridge, extending generally normally from said inner side of said skirt, a narrow portion of said first retainer ridge being of reduced height forming thereby a latch finger bypass opening through which said latch finger can pass for initiating removal of said cap from said neck, no other portion of said discontinuous first anchor ridge being narrower than said bypass opening, finger grip means for urging said cap away from said opening, and generally under said tear strip within the inclusive region from said second retainer ridge to said third retainer ridge, means for tactile indication by a finger of an operator, of the rotational location of said bypass opening by rotation of said cap while said finger is simultaneously in contact with said finger grip means, said second retainer ridge being continuous, said opening into said body having an opening sealing surface surrounding said opening, and said annular inner wall of said cap having a depending cap sealing surface which forms a seal with said opening sealing surface, said seal being spaced inward from the outer surface of said neck.

2. A closure system for a container and cap, said container having a body and a neck of said body comprising an opening into said body, said cap being for reversibly sealing said opening and comprising a closure seal, said neck and cap comprising a child proof lock, said closure system providing indication to a user of a first time breach of said closure seal, and comprising:

on an outer surface of said neck, in order from said opening, a first annular raised retainer ridge, a second annular raised retainer ridge generally parallel to and spaced from said first retainer ridge, and a third annular raised retainer ridge generally parallel to and spaced from said second retainer ridge, said cap including an annular inner wall, and depending from the periphery of said inner wall, an annular skirt comprising an inner side, an outer side, a first end, and a second end, said first end comprising said periphery of said inner wall, and on said inner side, in order from said first end, a first annular raised anchor ridge, a second annular raised anchor ridge generally parallel to and spaced from said first anchor ridge, and a third annular raised anchor ridge generally parallel to and spaced from said second anchor ridge, said first, second and third anchor rides being for bearing respectively against the first, second and third retainer ridges on their distal sides with respect to said opening when said cap is fully seated on said neck over said opening, said skirt comprising first and second separation bands of reduced thickness of said skirt, said first band being located between said first and second anchor ridges, said second band being located between said second and third anchor ridges, a tear strip comprising the annular portion of the skirt that is between said first and second bands, wherein removal of said tear strip frees said cap from the remainder of said skirt distal from said first band so that said cap is independent from said container when said cap is removed from said neck, means for pulling said tear strip from said skirt, said first annular raised anchor ridge being discontinuous, and having in series a single narrow latch finger in the plane of said first anchor ridge, extending generally normally from said inner side of said skirt, a narrow portion of said first retainer ridge being of reduced height forming thereby a latch finger bypass opening through which said latch finger can pass for initiating removal of said cap from said neck, no other portion of said discontinuous first anchor ridge being narrower than said bypass opening, finger grip means for urging said cap away from said opening, and generally under said tear strip within the inclusive region from said second retainer ridge to said third retainer ridge, means for tactile indication by a finger of an operator, of the rotational location of said bypass opening by rotation of said cap while said finger is simultaneously in contact with said finger grip means, and said first, second and third retainer ridges being approximately equal in their outer diameters.

3. The closure system for container and cap as described in claim 2, further comprising:

said remainder of said skirt distal from said second band remaining on said body when said tear strip is removed.

4. A closure system for a container and cap, said container having a body, and a neck of said body comprising an opening into said body, said cap being for reversibly sealing said opening and comprising a closure seal, said neck and cap comprising a child proof lock, said closure system providing indication to a user of a first time breach of said closure seal, and comprising:

on an outer surface of said neck, in order from said opening, a first annular raised retainer ridge, a second annular raised retainer ridge generally parallel to and spaced from said first retainer ridge, and a third annular raised retainer ridge generally parallel to and spaced from said second retainer ridge, said cap including an annular inner wall, and depending from the periphery of said inner wall, an annular skirt comprising an inner side, an outer side, a first end, and a second end, said first end comprising said periphery of said inner wall, and on said inner side, in order from said first end, a first annular raised anchor ridge, a second annular raised anchor ridge generally parallel to and spaced from said first anchor ridge, and a third annular raised anchor ridge generally parallel to and spaced from said second anchor ridge, said first, second and third anchor ridges being for bearing respectively against the first, second and third retainer ridges on their distal sides with respect to said opening, when said cap is fully seated on said neck, over said opening, said skirt comprising first and second separation bands of reduced thickness of said skirt, said first band being located between said first and second anchor ridges, said second band being located between said second and third anchor ridges, a tear strip comprising the annular portion of the skirt that is between said first and second bands, wherein removal of said tear strip frees said cap sufficiently from the remainder of said skirt distal from said first band so that said cap may be removed from said opening, means for pulling said tear strip from said skirt, said first annular raised anchor ridge being discontinuous, and having in series a single narrow latch finger in the plane of said first anchor ridge, extending generally normally from said inner side of said skirt, a narrow portion of said first retainer ridge being of reduced height forming thereby a latch finger bypass opening through which said latch finger can pass for initiating removal of said cap from said neck, and, finger grip means for urging said cap away from said opening, and generally under said tear strip, means, within the inclusive region from said second retainer ridge to said third retainer ridge, for tactile indication by a finger of an operator, of the rotational location of said bypass opening by rotation of said cap while said finger is simultaneously in contact with said finger grip means, a fourth annular raised ridge on the outer surface of said neck, generally parallel to and spaced from said third retainer ridge distally from said opening, an index key on said fourth ridge in predetermined location with respect to said latch finger bypass, said index key comprising a narrow portion of said fourth ridge having a change in shape with respect to the general shape of the remainder of said ridge, said index key change in shape extending generally normal to said fourth ridge, said opening into said body having an opening sealing surface surrounding said opening, said annular inner wall of said cap having a depending cap sealing surface which forms a seal with said opening sealing surface, said seal being spaced inward from the outer surface of said neck, and removal of said tear strip further freeing said cap sufficiently from the remainder of said skirt distal from said first band so that said cap is independent from said container when said cap is removed from said neck of said body.

* * * * *